US007720419B2

(12) United States Patent
Omata

(10) Patent No.: US 7,720,419 B2
(45) Date of Patent: May 18, 2010

(54) GLOSSY IMAGE FORMING SYSTEM AND COPY SURFACE SMOOTHING APPARATUS

(75) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 562 days.

(21) Appl. No.: 11/765,711

(22) Filed: Jun. 20, 2007

(65) Prior Publication Data

US 2007/0297839 A1 Dec. 27, 2007

(30) Foreign Application Priority Data

Jun. 21, 2006 (JP) ..... 2006-171551

(51) Int. Cl.
*G03G 15/20* (2006.01)

(52) U.S. Cl. ..... 399/320; 399/328; 399/341; 399/342

(58) Field of Classification Search ..... 399/320, 399/328, 341, 342
See application file for complete search history.

(56) References Cited

U.S. PATENT DOCUMENTS

2005/0025540 A1* 2/2005 Murai et al. ..... 399/341
2005/0111891 A1* 5/2005 Chen et al. ..... 399/328
2005/0185978 A1* 8/2005 Kemmochi ..... 399/69
2005/0271409 A1 12/2005 Omata

FOREIGN PATENT DOCUMENTS

| | | |
|---|---|---|
| JP | 64-35452 | 2/1989 |
| JP | 4-216580 A | 8/1992 |
| JP | 4-362679 A | 12/1992 |
| JP | 5-216322 A | 8/1993 |
| JP | 2003-84477 A | 3/2003 |

* cited by examiner

*Primary Examiner*—David P Porta
*Assistant Examiner*—Jessica L Eley
(74) *Attorney, Agent, or Firm*—Fitzpatrick, Cella, Harper & Scinto

(57) ABSTRACT

A glossy image forming system for forming a glossy image on a recording material having a surface resin material layer, the glossy image forming system includes a fixing device for fixing an unfixed toner image formed on a surface of the recording material; a heaterless pressing device for pressing the recording material having the toner image fixed by the fixing device; a smoothing device for smoothing the surface of the recording material pressed by the heaterless pressing device with a pressure smaller than a pressure applied by the heaterless pressing device.

11 Claims, 8 Drawing Sheets

GLOSSY IMAGE FORMING SYSTEM AND COPY SURFACE SMOOTHING APPARATUS

FIELD OF THE INVENTION AND RELATED ART

The present invention relates to a glossy image forming system for forming a glossy image on recording medium provided with a resinous layer, and a surface smoothing apparatus. A glossy image forming system and a copy surface smoothing apparatus are employed by a copying machine, a printer, a facsimile machine, etc., which employ an electrophotographic image forming method. They are also employed a multifunction image forming apparatus capable of performing two or more functions of the preceding image forming apparatuses.

An electrophotographic image forming apparatus, for example, an electrophotographic copying machine, an electrophotographic printer, an electrophotographic facsimile machine, and also, a multifunction image forming apparatus, that is, an image forming apparatus capable of performing two or more functions of the preceding apparatuses, have been widely known. Further, not only has an electrophotographic image forming apparatus which forms a black-and-white image been commercialized, but also, an electrophotographic image forming apparatus capable of forming a full-color image in addition to a monochromatic image, inclusive of a black-and-white image, has been commercialized. Further, an image forming apparatus has come to be used in various fields. Consequently, the image quality which a user requires from an electrostatic image forming apparatus has become higher and higher.

In recent years, glossiness has come to attract attention as one of the essential factors which make an image, in particular, a full-color image, appear higher in quality. As one of the factors which determine the glossiness level of an image, the smoothness of the surface of an image may be listed.

In order to deal with the above described need, the apparatus proposed in Japanese Laid-open Patent Applications S64-35452 and H05-216322 is structured as follows:

That is, as the recording medium for the apparatus, recording medium, the image formation surface of which is provided with a transparent resin layer formed of thermoplastic resin is used. Onto this recording medium, color toner made up of thermoplastic resin is transferred, and is melted with heat, to form a color image on the recording medium. Hereafter, recording medium, such as the above described one, which is provided with a transparent resin layer, will be referred to as resinous medium.

These apparatuses are structured so that an unfixed toner image is fixed to resinous medium with the use of a fixation roller and a pressure roller.

In order to improve a copy in smoothness, it is required to reduce in height the toner image step (step between surface area of recording medium, which is free of toner, and top surface of toner image on recording medium). However, it is rather difficult to reduce the toner image step with the use of a fixing apparatus which employs rollers such as those described above.

Thus, a fixing apparatus which employs a fixation belt (from which recording medium is separated by cooling recording medium) has been proposed, as a preferable fixing apparatus for an image forming apparatus which uses the abovementioned resinous medium, in Japanese Laid-open Patent Applications H04-216580 and H04-362679.

More concretely, these apparatuses heat, a recording medium, on which an unfixed toner image is present, while pressing the recording medium. Then, they let the resinous medium cool while keeping the resinous medium pressed on the belt. Then, they separate the resinous medium to from the belt.

Thus, not only can they properly embed the toner image in the resinous medium, but also, they can prevent the resinous medium from wrapping around the belt, and the toner from offsetting.

In other words, they can yield a color copy which is smooth across the entirety of the image bearing side, that is, a color copy superior in glossiness.

Incidentally, a resinous medium is described in detail in Japanese Laid-Open Patent Application No. 2003-084477. The resinous medium which is used by the apparatuses disclosed in this patent application is coated with such a transparent resin layer that is formed of primarily thermoplastic resin, which is no higher than 80 degrees in glass transition temperature and is roughly 100 μm in thickness.

However, it is possible that an image forming apparatus which employs the abovementioned belt-based fixing apparatus, and uses resinous medium, will suffer from the following problem.

That is, in order for a belt-based fixing apparatus such as the abovementioned one to yield a copy whose image bearing side is flat and smooth, the belt based fixing apparatus has to be greater than an ordinary fixing apparatus, in the amount of the pressure applied for fixation. Therefore, it is possible that not only will a toner image expand while it is in the melted state, but also, the toner image will be embedded in the resinous layer of the resinous medium while remaining in the expanded state. In other words, it is possible that the toner image will bleed.

Next, this phenomenon will be described with reference to FIG. 10, which is a schematic drawing. A resinous medium P is made up of a substrate, and a transparent resin layer P2 coated on the substrate. The substrate is a sheet of coated paper P1, and the transparent resin layer P2 is formed of thermoplastic resin.

FIG. 10(*a*) shows the state in which the resinous medium P and a toner image t are before they are subjected to the smoothing process; the toner image t, which is roughly several microns to several tens of microns in height, is on the top surface of the resinous medium P.

FIG. 10(*b*) shows the most desirable state, in which the resinous medium P and the toner image t can be after they are subjected to the smoothing process. In other words, FIG. 10(*b*) shows the toner image t which has been properly embedded into the resinous layer P2 of the resinous medium P; it shows the state in which the resinous medium P and toner image t will be after the glossiness of the copy is increased to a desired level.

However, the belt-based fixing apparatus in accordance with the prior art is substantial in the fixation pressure. Therefore, it causes the toner image t to spread and bleed as shown in FIG. 10(*d*). On the other hand, if a belt-based fixing apparatus is reduced in fixation pressure, the toner image step remains as shown in FIG. 10(*c*); the glossiness level of the copy fails to reach a desired level.

SUMMARY OF THE INVENTION

The primary object of the present invention is to provide a glossy image forming system and a copy surface smoothing apparatus, which are capable of forming a glossy image of high quality.

According to an aspect of the present invention, there is provided a glossy image forming system for forming a glossy image on a recording material having a surface resin material layer, said glossy image forming system comprising a fixing device for fixing an unfixed toner image formed on a surface of the recording material; a heaterless pressing device for pressing the recording material having the toner image fixed by said fixing device; and a smoothing device for smoothing the surface of the recording material pressed by said heaterless pressing device with a pressure smaller than a pressure applied by said heaterless pressing device.

According to an aspect of the present invention, there is provided a glossy image forming system for forming a glossy image on a recording material having a surface resin material layer, said glossy image forming system comprising a fixing device for fixing an unfixed toner image formed on a surface of the recording material; a heaterless pressing device for pressing the recording material having the toner image fixed by said fixing device; a belt having a glossiness (60°) of not less than 80 and not more than 110 and movable while being in contact to the surface of the recording material; a rotatable member cooperable with said belt to feed the recording material while being in contact to said belt by nipping the recording material therebetween with a pressure smaller than a pressure applied by said heaterless pressing device; and a cooling device for cooling the recording material moving in contact to said belt prior to separation of the recording material from said belt.

According to a further aspect of the present invention, there is provided a smoothing apparatus for smoothing a surface of the recording material to provide a glossy image with a surface of the recording material having a surface resin material layer, comprising a heaterless pressing device for pressing the recording material having a toner image fixed on the surface of the recording material; a belt having a glossiness (60°) of not less than 80 and not more than 110 and movable while being in contact to the surface of the recording material; a rotatable member cooperable with said belt to feed the recording material while being in contact to said belt by nipping the recording material therebetween with a pressure smaller than a pressure applied by said heaterless pressing device; and a cooling device for cooling the recording material moving in contact to said belt prior to separation of the recording material from said belt.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be concretely described. Incidentally, the following embodiments of the present invention are not intended to limit the present invention in scope. That is, the present invention includes the structurally modified versions of the following embodiments, as long as they fall within the gist of the present invention.

Further, in the following embodiments, the system made up of an image forming apparatus 100, a pressure application unit 300 as a toner image pressing device, and a belt-based smoothing (fixing) unit 400 as a smoothing device will be referred to as a glossy image forming system. Moreover, the system (apparatus) made up of a pressure application unit 300 and a belt-based smoothing (fixing) unit 400 will be referred to as a copy surface smoothing system (copy surface smoothing apparatus).

Embodiment 1

(1) Image Forming Portion

Figure 1:
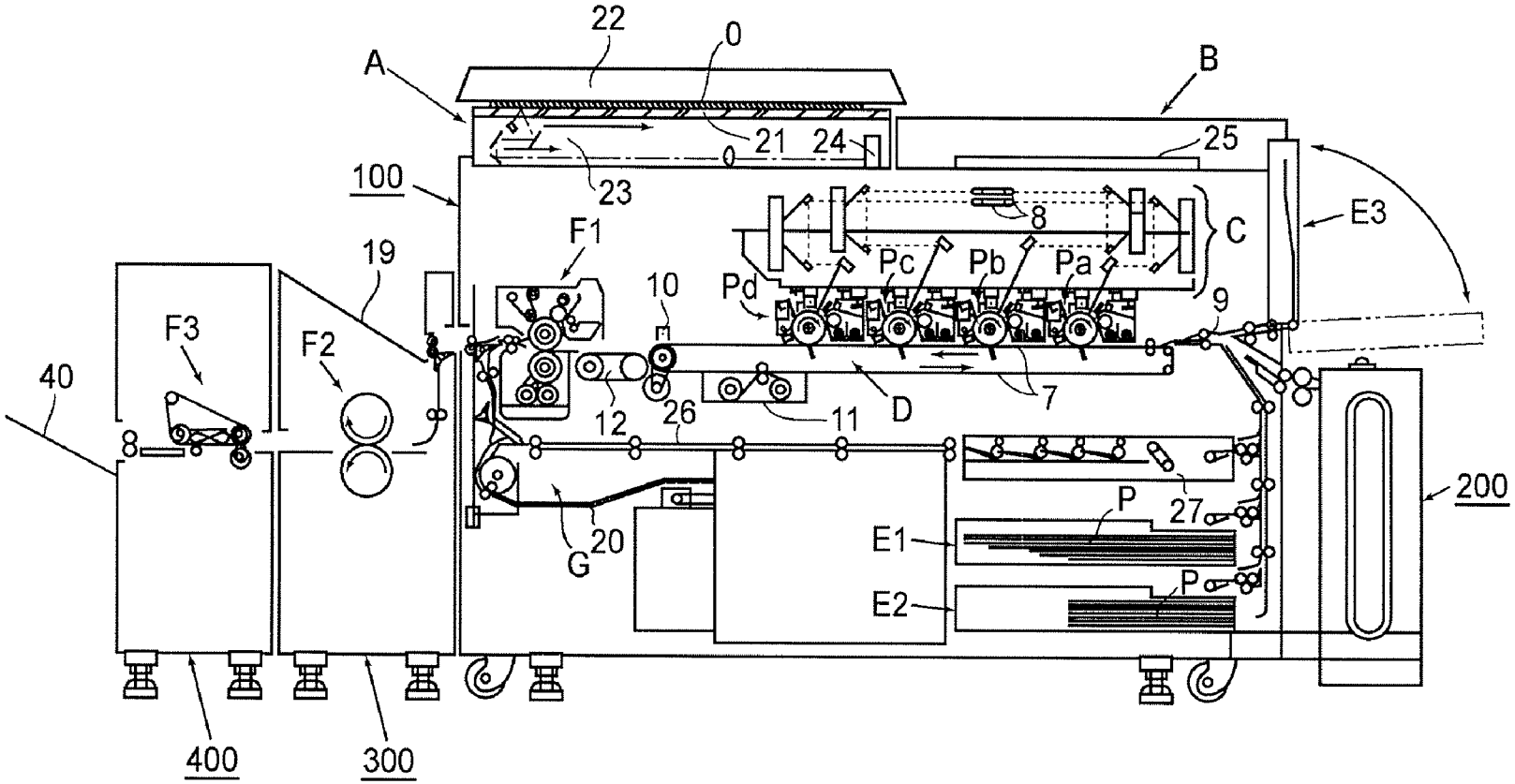
FIG. 1 is a schematic drawing of the image forming apparatus in the first embodiment of the present invention, showing the general structure of the apparatus.

FIG. 1 is a schematic drawing of the glossy copy outputting image forming apparatus in this embodiment, and shows the general structure of the apparatus. This image forming apparatus is an electrophotographic full-color image forming apparatus (copying machine, printer, facsimile machine, and multifunction machine capable of performing two or more functions of preceding machines). It has four drums juxtaposed in parallel (inline arrangement, tandem arrangement). First the image forming portions, that is, the portions which form an unfixed toner image, will be described.

Designated by a reference numeral 100 is the main assembly of the recording apparatus (which hereafter will be referred to as apparatus main assembly), and designated by a reference numeral 200 is a large capacity sheet feeding unit attached to the right-hand end (referring to drawing) of the apparatus main assembly 100. Designated by reference numerals 300 and 400 are a toner image pressing unit and a belt-based copy smoothing unit, respectively, which are attached in series to the left-hand end (reference to drawing) in the listed order. The toner image pressing unit 300 and belt-based copy smoothing unit 400 have a toner image pressing device F2 and a copy surface smoothing device F3, which are inside the toner image pressing unit 300 and copy surface smoothing unit 400, respectively. The abovementioned large capacity sheet feeding unit 200, toner image pressing unit 300, and copy surface smoothing unit 400 are optional units, which can be selectively attached to the apparatus main assembly 100 according to user preference. Incidentally, the toner image pressing unit 300 and copy surface smoothing unit 400 may be structured so that they can be disposed in a single shell to integrate them into a single optional unit (copy surface flattening and smoothing apparatus).

The apparatus main assembly 100 contains the first to fourth electrophotographic image forming portions Pa, Pb, Pc, and Pd, which are juxtaposed in parallel from the right to left (referring to drawing). Designated by referential characters A and B are an original reading portion and a control panel (display) portion, which are on top of the top surface of the apparatus main assembly 100. The original reading portion A optically scans an original O placed on an original placement platen 21, and separates the obtained optical image of the original into optical images having preset primary colors, one for one. The control display B is used by an operator to input control commands, and also, used to inform the operator of the state of the apparatus, or the like. Designated by a referential character C is a laser-based scanning mechanism (laser scanner) disposed directly above the abovementioned first to fourth image forming portions Pa, Pb, Pc, and Pd. The laser scanner C has multiple optical scanning means. Designated by a referential character D is a transfer belt mechanism disposed below the first to fourth image forming portions Pa, Pb, Pc, and Pd. Designated by referential characters E1 and E2 are the first and second sheet feeding cassettes. The sheet feeding cassettes E1 and E2 are located below the transfer belt mechanism, and are vertically stacked. Designated by a referential character E3 is a manual sheet feeding tray (manual sheet feeding portion), which is attached to the right-hand end of the apparatus main assembly 100 (referring to drawing). When this tray E3 is not in use, it is foldable against the apparatus main assembly 100, as indicated by a solid line in the drawing, whereas when it needs to be used, it is to be opened as indicated by a double-dot chain line in the drawing. Designated by a referential character F1 is the fixing apparatus of the apparatus main assembly, which is located on the downstream side of the transfer belt mechanism D in terms of the recording medium conveyance direction. In this embodiment, this thermal fixing apparatus is of the heat roller type.

Designated by reference numerals 21 and 22 are the original placement glass platen and an original pressing plate of the original reading portion A. The original pressing plate 22 can be opened or closed against the original placement glass platen 21. The original O (color original) is to be set on the glass platen 21. More specifically, the original O is to be placed on the glass platen 21 so that a preselected point (or edge) of the original O aligns with the original placement referential point (line) on the glass plate 21, and also, so that the image bearing side of the original O faces downward. Then, the original O and glass platen 21 is to be covered with the pressing plate 22. It is possible to replace the pressing plate 22 with an automatic original feeding apparatus (ADF, RDF) so that the original O (which is in the form of sheet) can be automatically fed into the original reading portion A. Designated by a reference numeral 23 is a movable optical system, which can be driven so that it moves following the bottom surface of the glass platen 21. The downwardly facing surface of the original O on the glass platen 21 is optically scanned by this movable optical scanning system 23. The portion of the scanning beam of light, which was reflected by the downwardly facing surface of the original O, is focused on a CCD 24, which is a photoelectric transducer (solid-state photographic element). Then, it is turned into three different picture signals, which correspond to the preset primary colors, which in this embodiment are R, G, and B (red, green, and blue). The thus obtained R, G, and B signals are inputted into an image processing portion 25 (which may be referred to as controller portion, control chip, etc.).

The image processing portion 25 controls the laser-based scanning mechanism C so that a beam of laser light is projected toward each of the first to fourth image forming portions Pa, Pb, Pc, and Pd while modulating the beam of laser beam with the picture information (electrical picture information) obtained by separating the optical image obtained by the original reading portion A, into the images having the primary colors.

When the image forming apparatus is in one of the ordinary printing modes, electrical picture information is inputted into the image processing portion 25 from an external host apparatus (unshown) such as a personal computer. When the image forming apparatus is in the facsimile receiving mode, the electrical picture information from the facsimile apparatus (unshown) of a facsimile sender is inputted into the image processing portion 25, whereas when in the facsimile transmitting mode, the image processing portion 25 transmits to the facsimile apparatus of a facsimile receiver, the electrical picture information of an original, which was obtained by photographically reading the original by the original reading portion A.

Figure 2:
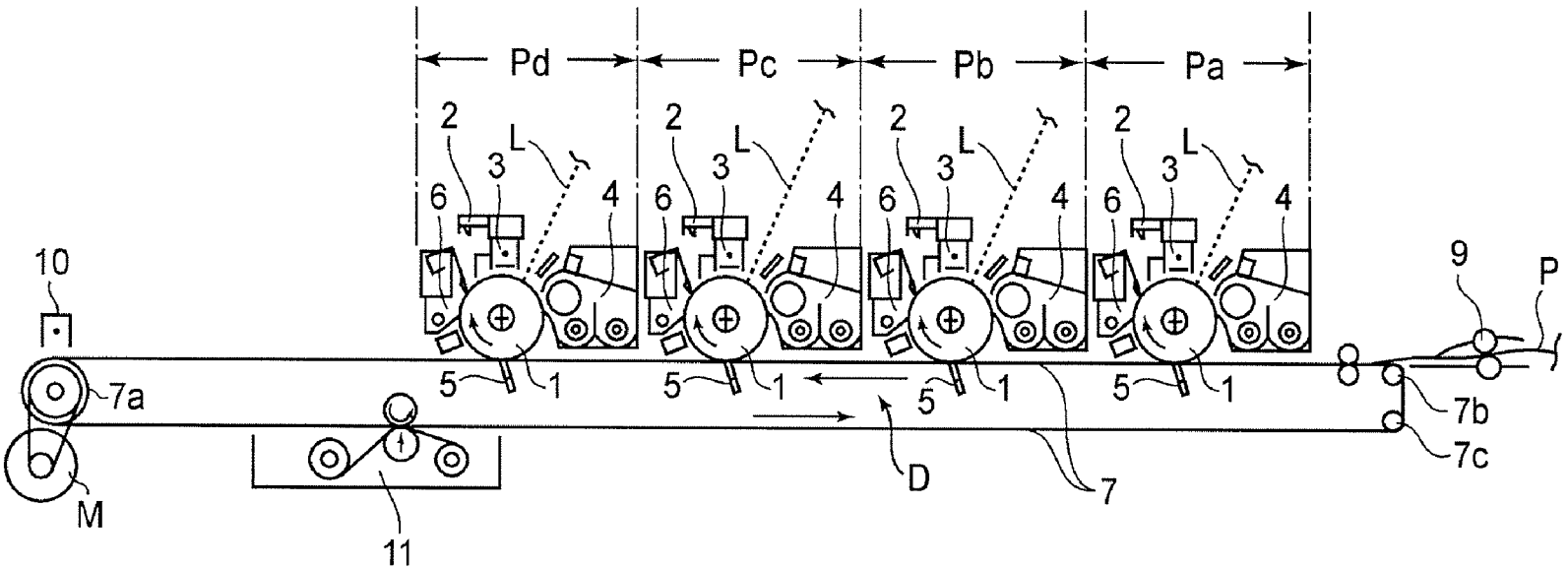
FIG. 2 is an enlarged drawing of the first to fourth image forming portions and transfer belt mechanism portion.

FIG. 2 is an enlarged drawing of the first to fourth image forming portions Pa, Pb, Pc, and Pd, and transfer belt mechanism portion D. The first to fourth image forming portions Pa, Pb, Pc, and Pd are electrophotographic image forming portions, and are similar in the electrophotographic process. That is, each image forming portion has an electrophotographic photosensitive drum 1 (which hereafter will be referred to as drum) as an image bearing member. Each image forming portion also has: a full exposure lamp 2 (charge removing lamp), a primary charging device 3, a developing device 4, a transfer charging device 5, a drum cleaner 6, etc., which are processing means which act on the drum 1. The developing devices 4, which the image forming portions have one for one, are filled with yellow (Y), magenta (M), cyan (C), and black (Bk) color toners, one for one.

The transfer belt mechanism D has an endless transfer belt 7, a driving roller 7*a*, and a pair of turn rollers 7*b* and 7*c*. The transfer belt 7 is stretched around the rollers 7*a*, 7*b*, and 7*c*, being thereby suspended by the rollers. The driving roller 7*a* is rotationally driven by a driving roller driving motor M through a motive power transmitting apparatus made up of a timing belt, etc. As the driving roller 7*a* is rotationally driven, the transfer belt 7 is circularly moved at a present velocity in the counterclockwise direction, that is, the direction indicated by an arrow mark. The transfer belt 7 is made up of a sheet of dielectric resin, such as polyethylene-terephthalate resin (PET sheet), polyfluorovinylidene resin, and polyurethane resin. As the transfer belt 7, an endless belt formed by joining, in an overlapping manner, the lengthwise ends of a strip sheet of such a dielectric resin, or a seamless endless belt is employed.

An operation for forming a full-color image is as follows. The first to fourth image forming portions Pa, Pb, Pc, and Pd are sequentially driven with preset control timing. As they are driven, the drum 1 of each image forming portion is rotated in the clockwise direction, that is, the direction indicated by an arrow mark. Further, the transfer belt 7 of the transfer belt mechanism D is rotationally driven, along with the laser-based scanning mechanism C. In synchronism with the driving of these portions, the primary charging device 3 uniformly charges the peripheral surface of the drum 1 to preset polarity and potential level. The laser-based scanning system C projects a beam of laser light L onto the surface of each drum 1 while modulating the beam with the picture signals. As a result, an electrostatic latent image, which reflects the picture signals, is formed on the peripheral surface of each drum 1.

More specifically, the beam of laser light L is projected from the light source apparatus of the laser-based scanning system C toward a polygon mirror 8 which is being rotated, causing the beam of laser light L to be deflected by the polygon mirror 8 so that the reflected beam of laser light moves in a scanning manner. The reflected beam of light, which is moving in the scanning manner, is deflected by a mirror, and is focused on the peripheral surface of the drum 1 by an f-θlens, exposing thereby the numerous points of the peripheral surface of the drum 1. As a result, an electrostatic latent image, which reflects the picture signals, is effected on the peripheral surface of the drum. The electrostatic latent image is developed into a toner image by the developing device 4.

The above described electrophotographic process forms on the peripheral surface of the drum 1 of the first image forming portion Pa, a toner image of yellow color, that is, the monochromatic image which corresponds to the yellow component of the intended full-color image. Further, it forms on the peripheral surfaces of the drums 1 of the second, third, and fourth image forming portions Pb, Pc, and Pd, toner images of magenta, cyan, and black colors, that is, the monochromatic images which correspond to the magenta, cyan, and black components, respectively, of the intended full-color image.

Meanwhile, the sheet feeding roller of the sheet feeding portion selected from among the large capacity sheet feeding apparatus 200, first sheet feeding cassette E1, second sheet feeding cassette E2, and manual sheet feeding tray E3, is driven. Thus, the multiple recording mediums P stacked in layers in the selected sheet feeding portion are fed into the apparatus main assembly 100 while being separated one by one. As each recording medium P is fed into the apparatus main assembly 100, it is delivered onto the transfer belt 7 of the transfer belt system D by way of multiple recording medium conveyance rollers and a pair of registration rollers 9. Then, the recording medium P is conveyed by the transfer belt 7 through the transfer portion of each of the first to fourth image forming portions Pa, Pb, Pc, and Pd, in the listed order.

Incidentally, when the image forming apparatus is in the operational mode for outputting a highly glossy image, resinous medium, that is, the recording medium having a resinous layer as the image formation surface (layer) is used as the recording medium P. Thus, when the image forming apparatus is in this operational mode, the recording mediums are delivered onto the transfer belt 7 from the sheet feeding portion which is holding the resinous mediums.

As it is confirmed that the preceding recording medium is at a preset point, the following recording medium P is sent out from the registration rollers 9, onto the transfer belt 7, and then, is conveyed toward the transfer portion of the first image formation portion Pa. At the same time, an image writing signal is inputted, and an image begins to be formed on the drum 1 of the first image forming portion Pa, in response to this signal, with preset control timing. While the image is formed on the drum 1, the transfer charging device 5 in the transfer portion which is under the downwardly facing portion of the peripheral surface of the drum 1 generates an electric field, or applies electric charge. As the result, the yellow toner image, that is, the toner image of the first color, is transferred onto the recording medium P. This transferring process causes the recording medium P to be securely held to the surface of the transfer belt 7 by electrostatic force. Then, the recording medium P are conveyed through the second to fourth image forming portions Pb, Pc, and Pd, in the listed order, while remaining securely held to the transfer belt 7. While the recording medium P is conveyed through these image forming portions Pb, Pc, and Pd, the magenta, cyan, and black toner images are sequentially transferred in layers onto the recording medium P, synthetically effecting an unfixed full-color toner image on the recording medium P.

As the transfer charging device 5, a contact charging device was employed. It has been known that keeping stable the amount of electrical current which contributes to image transfer makes the transfer charging means stable in image transfer performance. Thus, it is common practice to execute such a control that keep constant the amount of electric current, regardless of the type and specification (thickness, material, etc.) of recording medium, and also, regardless of the volumetric resistivity of recording medium, which is affected by the absorbency of recording medium, and the ambient conditions such as humidity.

After a full-color image is synthetically effected by the four monochromatic toner images of the primary colors, the electric charge of the recording medium P is removed by a separation charging device 10 while the recording medium P is conveyed through the downstream portion of the recording medium conveyance range of the transfer belt 7. As a result, the electrostatic attraction between the recording medium P and transfer belt 7 attenuates, allowing thereby the recording medium P to be separated from the transfer belt 7 at the downstream end of the recording medium conveyance range of the transfer belt 7. Incidentally, in an environment in which humidity is low, the recording medium P reduces in water content, becoming thereby higher in electrical resistance. Therefore, in a low humidity environment, the electrostatic attraction between the recording medium P and transfer belt 7 are greater, and therefore, the role which the separation charging device 10 plays is more important. Normally, the separation charging device 10 charges the recording medium P before the unfixed toner image on the recording medium P is fixed. Therefore, a charging device of the noncontact type is used as the separation charging device 10. Designated by a reference numeral 11 is a cleaning apparatus for cleaning the surface of the transfer belt 7.

After the recording medium P separated from the transfer belt 7, it is guided by a conveyer belt 12 into the fixing device F1 (which sometimes may be referred to as the pre-fixing device) with which the apparatus main assembly 100 is provided. The fixing device F1 is a fixing device which employs a pair of heat rollers as fixing means.

Figure 3:
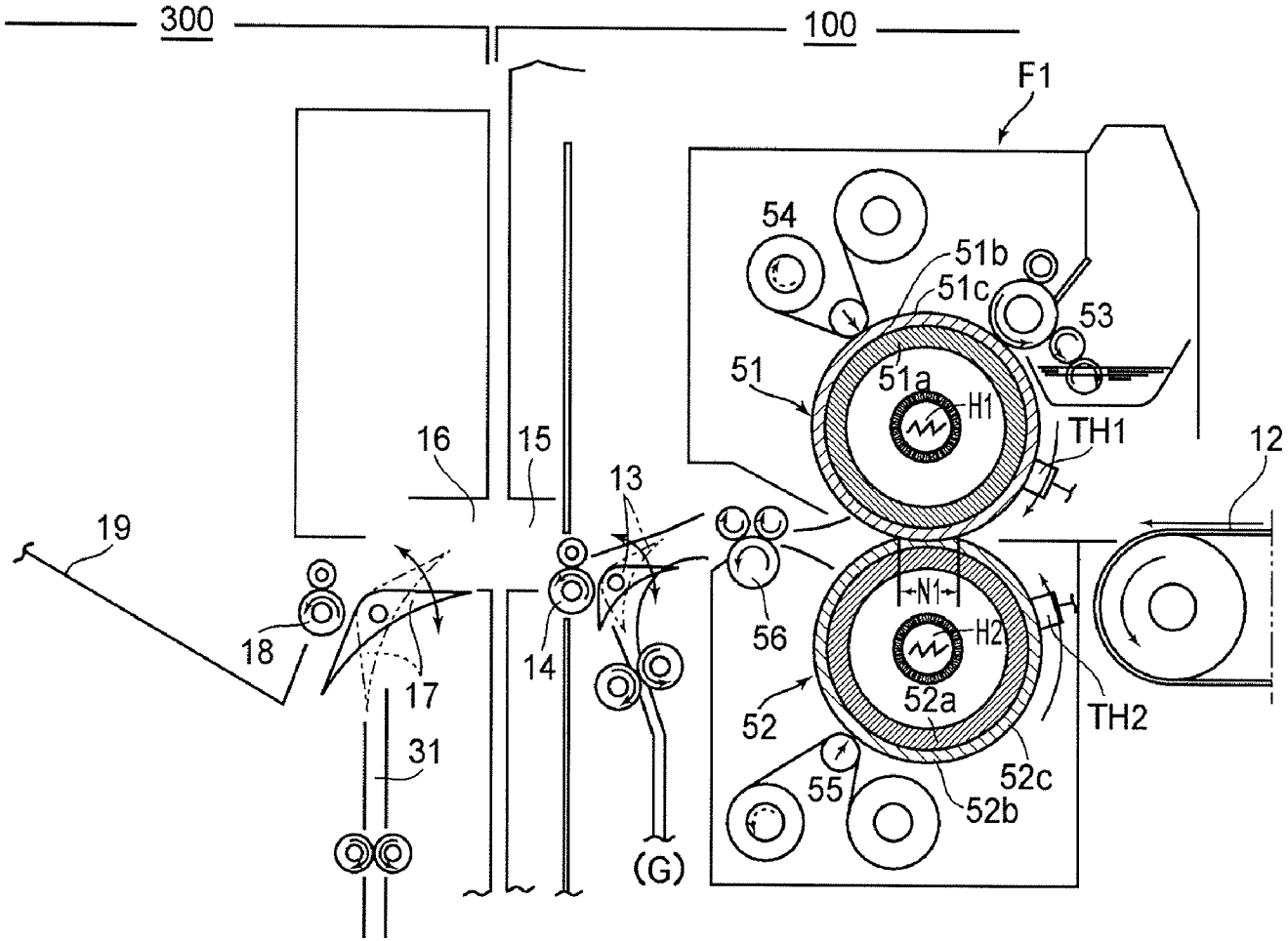
FIG. 3 is an enlarged drawing of the heat roller-based fixing device portion of the main assembly of the image forming apparatus.

FIG. 3 is an enlarged drawing of the fixing device F1, which is a heat roller-based fixing device and will be described later in detail in Section (2). After the recording medium P is guided into the fixing device F1, it is conveyed through a fixation nip N1, that is, the compression nip between a fixation roller 51 and a pressure roller 52, while remaining pinched between the two rollers 51 and 52. As a result, the recording medium P and the toner images, different in color, on the recording medium P are subjected to heat and pressure. As the recording medium P and toner images are subjected to heat and pressure, the toner images, different in color, are fixed to the recording medium P; the toner particles, different in color, are adhered in mixture to the recording medium P. After the recording medium P is conveyed through the fixation nip N1, it is further conveyed and discharged from the heat roller-based fixing device F1 by a sheet discharging roller 56 of the heat roller-based fixing device F1.

After the recording medium P is discharged from the heat roller-based fixing device F1, it is conveyed on the top side of a selector 13 (flapper, flag) of the apparatus main assembly 100, which is in the first attitude, that is, the attitude indicated by the solid line (FIG. 3). Then, it is further conveyed by the pair of discharge rollers 14 of the apparatus main assembly 100, into the recording medium entrance 16 of the toner image pressing unit 300.

When the image forming apparatus is in the mode in which the copy outputted from the apparatus main assembly 100 is not to be increased in glossiness, the selector 17 of the toner image pressing unit 300 is kept in the first attitude, that is, the attitude indicated by the solid line in FIG. 3. Thus, as the recording medium P advances into the toner image pressing unit 300 from the apparatus main assembly 100, it is conveyed on the top side of the selector 17, and is discharged by a pair of discharge rollers 18, while remaining pinched by the rollers 18, into a first delivery tray 19, which is on the top surface of the toner pressing unit 300.

Figure 4:
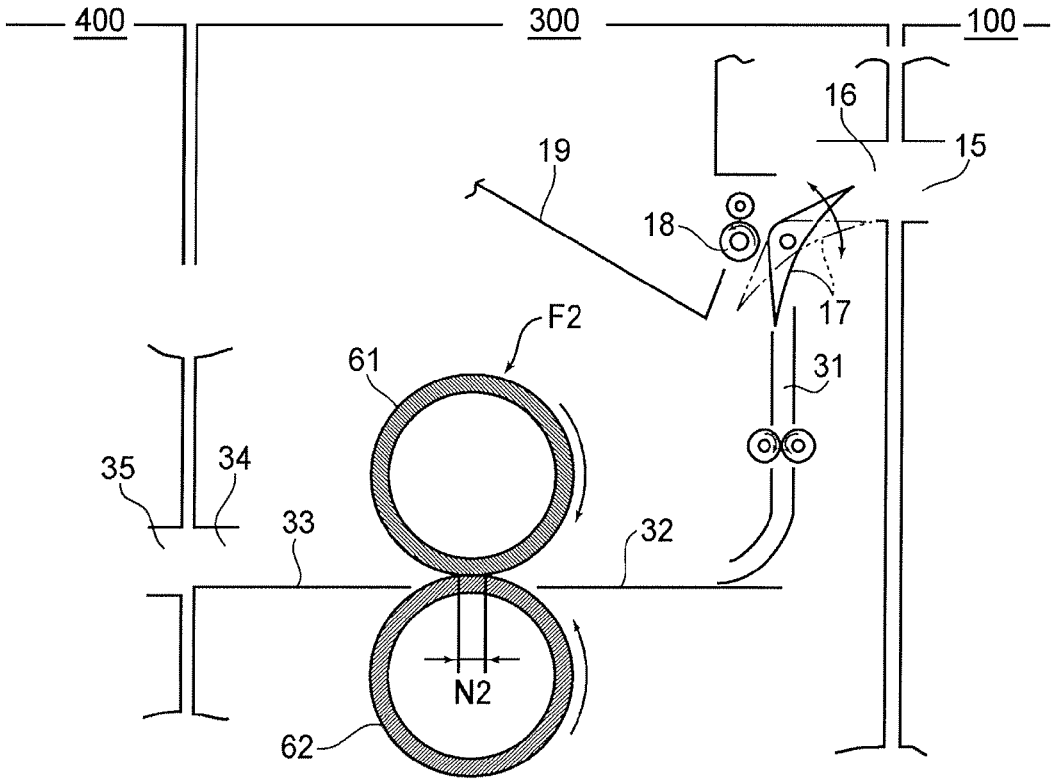
FIG. 4 is an enlarged drawing of the toner image pressing (fixing) device portion of the toner image pressing unit.

On the other hand, when the image forming apparatus is in the mode in which a copy is to be increased in glossiness immediately after it is outputted from the apparatus main assembly, the selector 17 of the toner image pressing unit 300 is kept in the second attitude, that is, the attitude indicated by the double-dot chain line in FIG. 3. Thus, as the recording medium P (resinous medium) advances into the toner image pressing unit 300 from the apparatus main assembly 100, it is changed in the direction in which it advances, by the selector 17; it is made to advance downward by the selector 17, being thereby guided into the fixing device F2 in the toner image pressing unit 300. The fixing device F2 is a device for pressing a toner image on the resinous medium into the resin layer of the medium, and therefore, will be referred to as toner image pressing device, hereafter. It will be described later in detail in Section (3). FIG. 4 is an enlarged drawing of the toner image pressing device F2 of the toner image pressing unit 300.

Referring to FIG. 4, as the recording medium P is switched in its advancement direction by the selector 17, which is in the second attitude, that is, the attitude indicated by the solid line, so that it advances downward, it enters a sheet passage 31, which is a downward sheet passage. Then, the recording medium P goes down through this sheet passage 31, and is guided by a horizontal guiding plate 32, into a fixation nip N2, that is, the compression nip between the pair of pressure rollers 61 and 62 of the toner image pressing device F2. Then, the recording medium P is conveyed through the fixation nip N2 while remaining pinched by the two pressure rollers 61 and 62. As a result, the toner image on the recording medium P is embedded into the resin layer of the resinous medium.

Figure 5:
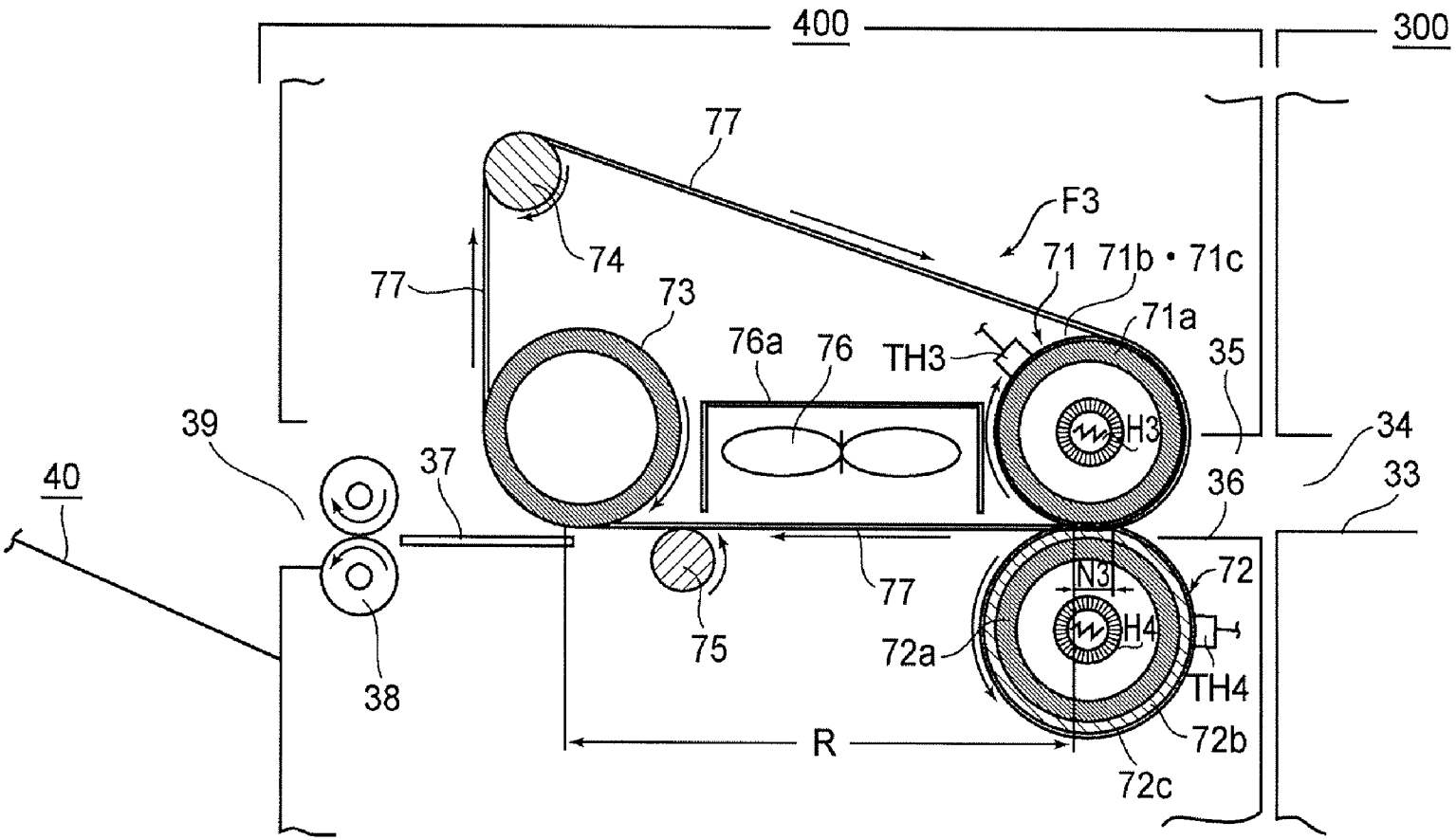
FIG. 5 is an enlarged drawing of the belt-based smoothing (fixing) device of the copy surface smoothing unit.

After the recording medium P is moved through the fixation nip N2, it is conveyed further while being guided by a horizontal guiding plate 33, which is located on the outlet side of the fixation nip N2. Then, it is moved out of the toner image pressing unit 300 through the sheet outlet of the toner image pressing unit 300, and is made to advance into the recording medium entrance 35 of the belt-based fixing unit 400. The belt-based fixing unit 400 is a unit for smoothing, across the image bearing side, the copy outputted from the toner image processing unit 300. As the recording medium P advances into the belt-based fixing unit 400, or the copy surface smoothing unit, it is guided into the belt-based fixing device F3, which will be described later in detail in Section (4). FIG. 5 is an enlarged drawing of the belt-based fixing device F3.

Referring to FIG. 5, after the recording medium P is guided into the copy surface smoothing unit 400, it is guided by a horizontal guiding plate 36 into the belt-based fixing device F3, in which the abovementioned surface of the copy is smoothed, and also, in which the recording medium is cooled so that is can be separated from the fixation belt. Thus, as the copy outputted from the toner image pressing unit 300 is conveyed through the belt-based fixing device F3, it comes out as a highly glossy copy. More concretely, as the copy is conveyed through the belt-based fixing device F3, the glossiness of the image formation surface layer (transparent resin layer) of the recording medium P becomes similar to that of the fixation belt (which will be described later) of the belt-based fixing device F3; the copy is increased in glossiness so that its glossiness level (60°) reaches a level which is no less than 80° and no more than 100°.

Then, the recording medium P is separated from the fixation belt 77 of the belt-based fixing device F3, and is guided into a pair of sheet discharging rollers 38 by a guiding plate 37. Then, it is conveyed further by the pair of sheet discharging rollers 38 while remaining pinched between the pair of sheet discharging rollers 38 so that it is discharged through a sheet outlet 39 into a second delivery tray 40, which is attached to the exterior of the left end wall of the copy surface smoothing unit 400.

When the image forming apparatus is in the two-sided image formation mode, the recording medium P is conveyed as will be described next. That is, after the recording apparatus P came out of the heat roller-based fixing device F1, that is, the fixing device of the apparatus main assembly 100, it has the toner image fixed to its first image formation surface. Then, the recording medium P is changed in its advancement direction by the selector 13, which is in the second attitude, that is, the attitude indicated by the double-dot chain line in FIG. 3, being thereby directed toward a mechanism G which turns over the recording medium P and re-feeds the recording medium P into the apparatus main assembly 100. Then, as the recording medium P is conveyed through this reversing-and-re-feeding mechanism G, it is turned over by the recording sheet turning portion 20 (switch-back mechanism). Then, it is sent to the two-side image formation sheet passage 26, and delivered into an intermediary tray 27, in which it is temporarily stored. Then, a sheet feeding roller begins to be driven with preset control timing so that the recording medium P in the intermediary tray 27 is sent out by the sheet feeding roller toward the registration rollers 9. Then, the recording medium P is delivered for the second time onto the transfer belt 7 of the transfer belt mechanism D, with it second image formation surface facing upward. Then, four monochromatic toner images, different in color, are sequentially transferred onto the second image formation surface of the recording medium P, in the first to fourth image forming portions Pa, Pb, Pc, and Pd, respectively, synthetically effecting an unfixed full-color toner image on the second image formation surface, as it was on the first image formation surface. After the formation of the second unfixed full-color toner image on the second image formation surface of the recording medium P, the recording medium P is separated from the transfer belt 7, and is conveyed to the heat roller-based fixing device F1, in which the unfixed toner image on the second image formation surface of the recording medium P is fixed to the second image formation surface of the recording medium P.

The image forming apparatus in this embodiment is capable of outputting a monochromatic color copy or black-and-white copy. If the monochromatic color image or black-and-white image formation mode is selected, only the image formation portion which corresponds in color to the selected color (including black) is activated for image formation, among the first to fourth image forming portions Pa, Pb, Pc, and Pd. That is, the other image forming portions are also rotationally driven but are not activated for image formation. The sequence for transferring a toner image onto the recording medium P while the recording medium P is conveyed by the transfer belt mechanism D is carried out only in the transfer portion of the activated image forming portion.

(2) Heat Roller-Based Fixing Device F1 (Thermal Fixing Device)

Referring to FIG. 3, the heat roller-based fixing device F1, that is, the internal fixing device of the recording apparatus main assembly 100, will be described. The main function of the heat roller-based fixing device F1 in this embodiment is to properly fix an unfixed toner image to the recording medium. Thus, when the image forming apparatus is in the normal image formation mode, the heat roller-based fixing device F1 normally fixes toner images. However, if the image forming apparatus is in the abovementioned glossy copy outputting mode, the heat roller-based fixing device F1 plays a function which is slightly different from its primary function. More concretely, it plays the function of preparatorily fixing an unfixed toner image to resinous medium.

Designated by the reference numerals 51 and 52 are the fixation roller and pressure roller, respectively, which are rotatably supported with the use of bearings. The two rollers 51 and 52 are vertically stacked in parallel, and are kept pressed upon each other, forming thereby the fixation nip N1.

The fixation roller 51 is a laminar roller, which has three concentric layers, that is, a core portion 51*a*, an elastic layer 51*b*, and a release layer 51*c*. The core portion 51*a* is made up of a hollow aluminum pipe, which is 44 mm in diameter and 5 mm in thickness. The elastic layer 51*b* is formed of silicon rubber. It is 50° in JIS hardness scale A, and 2.5 mm in thickness. The release layer 51*c* is formed of PFA, and is 50 μm in thickness. In the hollow of the core portion 51*a*, that is, a hollow aluminum pipe, a halogen lamp H1 is positioned as a heat source (roller heater).

The pressure roller 52 is also a laminar roller as is the fixation roller 51. It also has three concentric layers, that is, a core portion 52*a*, an elastic layer 52*b*, and a release layer 52*c*. However, the elastic layer 52*b*, which is also formed of silicon rubber, is 3 mm in thickness, because, in principle, increasing the elastic layer 52*b* in thickness can increase the width of fixation nip N1. Designated by a referential character H2 is a halogen lamp as a heat source (roller heater), which is positioned in the hollow of the core portion 52*a*, that is, a hollow aluminum pipe, of the pressure roller 52.

The fixation roller 51 and pressure roller 52 are kept pressed upon each other, with the application of a preset amount of pressure, forming the fixation nip N1, as a heating-and-pressing portion, which has a preset width in terms of the recording medium conveyance direction. The total amount of pressure applied to the pressure roller 52 to keep the two rollers 51 and 52 pressed upon each other was set to 294 N (30 kgf), and the width of the resultant fixation nip N was 7 mm.

The fixation roller 51 and pressure roller 52 are rotationally driven by a roller driving motor (not shown) in the direction indicated by an array mark while remaining pressed upon each other. The heaters H1 and H2 generate heat as they are supplied with electric power from an electric power circuit (not shown). The fixation roller 51 and pressure roller 52 are heated from within by the heat generated by the heaters H1 and H2, respectively. The surface temperatures of the fixation roller 51 and pressure roller 52 are monitored by temperature sensors TH1 and TH2, such as thermistors, which are placed in contact with the fixation roller 51 and pressure roller 52, respectively. The electrical information regarding the detected temperatures is inputted into a fixation control portion (not shown). The fixation control portion controls the amount by which electric power is supplied from the electric power circuit to the heaters H1 and H2, in response to the inputted information, so that the surface temperatures (fixation temperatures) of the fixation roller 51 and pressure roller 52 are maintained at a preset control level. That is, the temperatures of the fixation roller 51 and the pressure roller 52 are controlled so that they remain at a preset level, in order to control the temperature of the fixation nip N1 so that it remains at a preset fixation temperature level.

Designated by a reference numeral 53 is a releasing agent coating apparatus for coating releasing agent, such as dimethyl silicon oil, on the surface of the fixation roller 51. Designated by a reference numeral 54 is a cleaning apparatus of the web-type, which is for wiping the surface of the fixation roller 51 to clean the surface. Designated by a reference numeral 55 is a cleaning apparatus of the web-type, which is for wiping the surface of the pressure roller 52 to clean the surface. A web is a heat resistant cleaning member.

The fixation roller 51 and pressure roller 52 are rotationally driven, and are heated from within by the heaters H1 and H2, respectively, so that the surface temperatures of the fixation roller 51 and pressure roller 52 are raised to, and kept at, the preset control level. While the fixation roller 51 and 52 are in this state, the recording medium P, which is bearing an unfixed toner image, is introduced into the fixing device F1 by the conveyer belt 12 from the transfer belt mechanism side, is made to enter the fixation nip N1, and is conveyed through the fixation nip N1 while remaining pinched between the fixation roller 51 and pressure roller 52. While the recording medium P is conveyed through the fixation nip N1, it is heated by the fixation roller 51 and pressure roller 52, and is pressed by the fixation nip N1. Therefore, the layered yellow, magenta, cyan, and black toner images on the recording medium P are fixed to the surface of the recording medium P. That is, as the toner particles, of which the four toner images are formed, are heated and pressured, they melt and mix, effecting thereby a permanent full-color image on the recording medium P. Coming out of the fixation nip N, the recording medium P is separated from the fixation roller 51 or pressure roller 52 by an unshown separation claw, is relayed by the discharge rollers 56, and is sent out of the heat roller-based fixing device F1.

The releasing agent coating apparatus 53 coats the surface of the fixation roller 51 with silicone oil to prevent the toner from adhering to the surface of the fixation roller 51 while the recording medium P is conveyed through the fixation nip N1. The cleaning apparatuses 54 and 55 remove the toner having offset onto the peripheral surface of the fixation roller 51 and pressure roller 52, respectively.

(3) Fixing Device F2 (Toner Image Pressing Device)

The fixing device F2, as the internal toner image pressing device of the toner image pressing unit 300 does not have a heat source such as a heater. Incidentally, for convenience, the fixing device F2 is referred to as toner image pressing device. However, it is the heat roller-based fixing device F1 that actually fixes the toner images to resinous medium. That is, the role of the fixing device F2, that is, the toner image pressing device, is not to fix the toner images but to apply pressure to the toner image on the resinous medium (and resinous medium).

Next, referring to FIG. 4, designated by reference numerals 61 and 62 are a pair of pressure application rollers (pressure rollers), which are vertically stacked in parallel. The pressure rollers 61 and 62 are kept pressed upon each other so that the fixation nip N2 is formed between them. Both the top and bottom rollers are made up of hollow aluminum pipes, and are 60 nm in diameter and 5 mm in thickness. The total amount of pressure applied to keep the pair of pressure rollers 61 and 62 upon each other is 1470 N (150 kgf). The surface layer of the top pressure roller 61 (fixation roller), or the roller which contacts the image bearing surface of the recording medium P, may be formed of a metallic substance. However, from the standpoint of preventing toner offset, the top roller 61 may be covered with a piece of tube formed of PFA, PTFE, or the like, or may be coated with PFA, PTFE, or, the like.

The pair of pressure roller 61 and 62 are rotationally driven by a pressure roller driving motor (not shown) in the direction indicated by an arrow mark while remaining pressed upon each other. The recording medium P, on which the toner image is present, is made to enter the fixation nip N2, and is conveyed through the nip N2 while remaining pinched between the two rollers 61 and 62. Thus, as the recording medium P is conveyed through the fixation nip N2, the toner image on the recording medium P is pressed against the recording medium P, becoming thereby virtually embedded in the recording medium P. During this process, the conveyance of the recording medium P, that is, a resinous medium, through the fixation nip N2, is likely to increase the temperatures of the pair of pressure rollers 61 and 62. Thus, the following measures are taken.

That is, in this embodiment, the number by which the resinous mediums are allowed to be continuously conveyed between the rollers 61 and 62 per unit of time is set so that the temperatures of the pair of pressure rollers 61 and 62 are maintained at a level below the glass transition point Tg of the toner.

(4) Belt-based Fixing Device F3 (Copy Surface Smoothing Device)

Next, the belt-based internal fixing apparatus F3 of the copy surface smoothing unit 400 will be described. Incidentally, in this embodiment, for the sake of convenience, the belt-based fixing device is referred to as "fixing device". However it is the heat roller-based fixing device F1 that actually fixes the toner image to resinous medium. That is, the role of the belt-based fixing device F3 is not to fix the toner image but to "smooth" the surface of the preparatorily fixed copy, that is, the combination of the resinous medium and the toner image thereon, after the preparatorily fixed copy is processed by the fixing device F2, that is, the toner image pressing device.

Referring to FIG. 5, the belt-based fixing device F3 has a first fixation roller 71 (which hereafter will be referred to simply as a fixation roller), a roller 73, a roller 74, and an endless fixation belt 77. The fixation roller 71 is a heat roller. The roller 73 is disposed a preset distance away from the fixation roller 71, and functions as a separation roller. The fixing device F3 has also a roller 74, which is disposed on the top side of the separation roller 73, and functions as a tension roller (therefore, it will be referred to as tension roller 74 hereafter). The endless fixation belt 77 is a glossiness increasing belt, and is stretched around these three rollers 71, 73, and 74, being suspended thereby. The belt-based fixing device F3 also has a second fixation roller 72 (which hereafter will be referred to as a pressure roller). The pressure roller 72 is kept pressed again the fixation roller 71, with the presence of the fixation belt 77 between the two rollers 72 and 71. Further, the belt-based fixing device F3 has an auxiliary roller 75, which is in contact with the outward surface of the fixation belt 77, in terms of the loop which the fixation belt 77 forms. In terms of the moving direction of the fixation belt 77, the auxiliary roller 75 is located between the fixation roller 71 and separation roller 73, being closer to the separation roller 73. Further, the belt-based fixing device F3 has a cooling fan 76 as the cooling means for air cooling the portion of the fixation belt 77, which is moving between the fixation roller 71 and separation roller 73. In terms of the moving direction of the fixation belt 77, the cooling fan 76 is located between the fixation roller 71 and separation roller 73. With reference to the loop which the fixation belt 77 forms, the cooling fan 76 is on the inward side. The abovementioned fixation roller 71, pressure roller 72, separation roller 73, tension roller 74, and auxiliary roller 75 are disposed virtually in parallel.

The fixation roller 71 is a laminar roller, which has three concentric layers, that is, a core portion 71*a*, an elastic layer 71*b*, and a release layer 71*c*. The core portion 71*a* is made up of a hollow aluminum pipe, which is 44 mm in diameter and 5 mm in thickness. The elastic layer 71*b* is formed of silicon rubber. It is 50° in JIS hardness scale A, and 300 μm in thickness. The release layer 71*c* is formed of PFA, and is 50 μm in thickness. In the hollow of the core portion 71*a*, that is, a hollow aluminum pipe, a halogen lamp H3 is positioned as a heat source (roller heater). The heat source does not need to be limited to a halogen heater. That is, a heat source structured so that a fixation roller is heated by electromagnetic induction with the use of the magnetic flux generated by an exciter coil may be employed.

The pressure roller 72 is also a laminar roller as is the fixation roller 71. It also has three concentric layers, that is, a core portion 72*a*, an elastic layer 72*b*, and a release layer 72*c*. However, the elastic layer 72*b*, which is also formed of silicon rubber, is 3 mm in thickness, because, in principle, making the elastic layer 72*b* thicker can increase the width of fixation nip N3. Designated by a referential character H4 is a halogen lamp as a heat source (roller heater), which is positioned in the hollow of the core portion 72*a*, that is, a hollow aluminum pipe, of the pressure roller 72.

The fixation roller 71 and pressure roller 72 are kept pressed upon each other, with the presence of the fixation belt 77 between the two rollers 71 and 72, with the application of a preset amount of pressure, forming the fixation nip N3, as a heating-and-pressing portion, which has a preset width in terms of the recording medium conveyance direction. The total amount of pressure applied to the pressure roller 72 to keep the two rollers 71 and 72 pressed against each other was set to 490 N (50 kgf), and the width of the resultant fixation nip N2 was 5 mm.

The surface hardness of the fixation roller 71 must be set to match the properties of the fixation belt 77. If the fixation roller 71 is excessively soft in surface hardness, the fixation belt 77 is allowed to slacken, failing to satisfactorily embed the toner into the surface layer of the recording medium, which is formed of a resinous substance. Thus, if the fixation roller 71 is excessively soft, the toner image step remains after the fixation by the belt-based fixing device F3. On the other hand, if the fixation belt 77 is soft, the fixation roller 71 may be increased in hardness. As the mans for satisfactorily hardening the fixation roller 71, the elastic layer may be reduced in thickness, or eliminated, leaving only the surface layer formed of PFA, or both the elastic layer and the surface layer formed of PFA may be eliminated. The core may be a piece of plane aluminum cylinder.

The fixation belt 77, which functions as a glossiness increasing belt, is a belt formed of a heat resistant resin, for example, and is flexible. It may be a single-layer belt, or a multilayer belt. Since the fixation belt 77 is used for yielding a highly glossy copy, one of its surfaces (surface which comes into contact with image on recording medium P) is made smooth like a mirror surface (surface which comes into contact with toner image is flat and smooth like mirror surface).

More concretely, the mirror-like smoothness (glossiness level (60°)) of the belt surface can be measured with the use of a hand held glossmeter PG-1M (product of Nippon Denshoku Kogyo Co., Ltd.). This glossiness is based on JIS Z 8741. The glossiness of the fixation belt 77 is desired to be no less than 80 and no more than 110. Using a fixation belt, the glossiness of which is within this range, as the fixation belt 77, can make it possible to yield a copy which is satisfactorily high in glossiness.

The fixation roller 71 is rotationally driven by a driving mechanism (not shown at a preset velocity in the clockwise direction, that is, the direction indicated by an arrow mark. This rotational driving of the fixation roller 71 causes the fixation belt 77 to circularly move in the clockwise direction, or the direction indicated by an arrow mark. The separation roller 73, tension roller 74, pressure roller 72, and auxiliary roller 75 are rotated by the rotation of the fixation belt 77. The tension roller 74 provides the fixation belt 77 with a preset amount of tension.

The heaters H3 and H4, which are in the hollows of the fixation roller 71 and pressure roller 72, respectively, generate heat as they are supplied with electric power from an electric power circuit (not shown). The fixation roller 71 and pressure roller 72 are heated from within by the heat generated by the heaters H3 and H4, respectively. The surface temperatures of the fixation roller 71 and pressure roller 72 are monitored by temperature sensors TH3 and TH4, such as thermistors, which are placed in contact with the fixation roller 71 and pressure roller 72, respectively. The electrical information regarding the detected temperatures is inputted into the fixation control portion (not shown). The fixation control portion controls the amount by which electric power is supplied from the electric power circuit to the heaters H3 and H4, in response to the inputted information, so that the surface temperatures (fixation temperatures) of the fixation roller 71 and pressure roller 72 are maintained at a preset control level. That is, the temperatures of the fixation roller 71 and pressure roller 72 are controlled so that they remain at preset levels, in order to control the temperature of the fixation nip N3 so that it remains at a preset fixation temperature level.

The recording medium P, on the surface of which the toner image is present, is sent to the belt-based fixing device F3, is guided into the fixation nip N3, and is conveyed through the fixation nip N3 while remaining pinched between the fixation belt 77 and pressure roller 72. During this process, the surface of the recording medium P, on which the toner image is present, faces the surface of the fixation belt 77. While the recording medium P is conveyed through the fixation nip N3, the recording medium P and the toner image thereon are heated and pressed so that the toner image, and the surface layer of the recording medium P, which is a thermoplastic resin layer, soften and melt. Also during this process, the temperature of the fixation belt 77 is kept at a level which is sufficiently higher than the glass transition temperature Tg of the toner, in order to properly soften the toner images and the thermoplastic surface layer of the recording medium P. Thus, the toner images, different in color, on the recording medium P are melted while being mixed, and then, become fixed to the recording medium P. The recording medium P remains flatly adhered to the surface of the fixation belt 77.

Thereafter, the recording medium P is conveyed to the cooling area R (cooling portion) by the circular movement of the fixation belt 77 while remaining flatly adhered to the fixation belt 77. The cooling area R is between the fixation nip N3 and separation roller 73. While the recording medium P is conveyed through this cooling area R, it is efficiently cooled by the function of the air which is forcefully flowed by a cooling fan 76 (cooling device) through an air duct 76*a* which surrounds the cooling fan 76. The direction of the air flow generated by the cooling fan 76 is perpendicular to the surface of the recording medium P. While the recording medium P is conveyed through the cooling device 76 structured as described above, the recording medium P which is flatly in contact with the fixation belt 77 is cooled in the cooling area R so that its temperature falls below the glass transition temperature of the toner image.

The target temperature level to which the temperature of the recording medium P is to be reduced by the cooling device 76 of the belt-based fixing device F3 is desired to be no higher than the melting point of the toner, preferably, no higher than the glass transition temperature Tg of the toner.

When the temperature of toner is below the melting point of toner, toner exhibits fairly high degree of elasticity, being in the state of almost solid. However, when the temperature of the toner is below its glass transition temperature Tg, toner exhibits virtually no elasticity, remaining virtually solid.

It is ideal that while the recording medium P is conveyed through the cooling area R, its temperature falls below the glass transition temperature Tg of the toner. Thus, it is desired that the cooling device of the belt-based fixing device F3 is satisfactorily high in cooling performance, and/or the length of the cooling area R is long enough for satisfactorily cooling the recording medium P. Satisfying these desires results in the increase in the apparatus size. Moreover, increasing the fan in cooling performance leads to cost increase, and also, reduction in energy efficiency. Thus, it is not mandatory to reduce the temperature of the recording medium P bellow the glass transition temperature Tg of the toner while the recording medium P is conveyed through the cooling area R, provided that the recording medium P can be cooled to cause its temperature to fall below the melting point of the toner so that the recording medium P can be separated from the fixation belt 77.

As described above, while the recording medium P is conveyed through the cooling area R while remaining flatly in contact with the surface of the fixation belt 77, it is sufficiently cooled. Then, it is conveyed to the position of the separation roller 73 by which the fixation belt 77 is made to curve. Thus, the recording medium P is made to separate from the surface of the fixation belt 77 by its own resiliency, in the area in which the fixation belt 77 is made to curve; in other words, the recording medium P is separated from the fixation belt 77 by the curvature of the fixation belt 77.

It is possible that while the recording medium P is conveyed through the cooling area R, that is, the area between the fixation nip N3 and the separation roller 73, the recording medium P will become separated from the surface of the fixation belt 77, and therefore, the toner images on the recording medium P will become disturbed, or it will become impossible to convey the recording medium P. Thus, the belt-based fixing device F3 is provided with the auxiliary roller 75 to prevent the above described problem.

The cooling device 76 does not need to be a fan. Needless to say, it may be a cooling device of the contact type. For example, a Peltier element, a heat pipe, or a water circulating cooling device, may be employed.

The recording medium P used in this embodiment to yield a highly glossy copy is a laminar recording medium, for example, a recording medium made up of a substrate layer, which is a sheet of ordinary paper, and an image formation layer (toner embedment layer, image embedment layer, gloss providing layer) formed of a thermoplastic resin and layered on the substrate layer. This image formation layer is the layer on the surface of which a toner image is formed.

While a resinous medium as the recording medium P used for outputting a glossy copy is conveyed through the fixation nip N3 of the belt-based fixing device F3, the resinous surface layer of the recording medium is increased in temperature by the heat in the fixation nip N3, becoming thereby softer. Further, the toner is embedded further into the resinous surface layer (which is high in temperature), by the pressure in the fixation nip N3, and the recording medium is pressed upon the surface of the fixation belt 77 with the presence of no gap between the recording medium and the surface of the fixation belt 77. Thereafter, the recording medium P is conveyed further, while remaining in contact with the fixation belt 77, by the circular movement of the fixation belt 77 through the cooling area R. As the recording medium P is conveyed through the cooling area R, it is forcefully, efficiently, and sufficiently cooled. Then, the recording medium P is separated from the fixation belt 77 by the curvature of the fixation belt 77, in the area in which the fixation belt 77 is bent in a curve by the separation roller 73. During this process, the resinous surface layer and toner image solidify in a manner to conform to the mirror-like texture of the surface of the fixation belt 77. Thus, the entire surface of the copy becomes flatter and smoother. In other words, an excellently glossy copy can be obtained.

(5) Resinous Medium

Next, a recording medium used for outputting a glossy copy, that is, a recording medium whose surface layer is a resinous layer (toner embedment layer, gloss providing layer), will be described in more detail.

This recording medium is structured so that, as the belt-based fixing device F3 reaches close to its target temperature level, its resinous layer, that is, its outermost layer, softens with the toner thereon to allow the toner image to be embedded into the resinous layer in order to reduce in size the toner image step, that is, the step between the toner image surface and recording medium surface.

Figure 6:
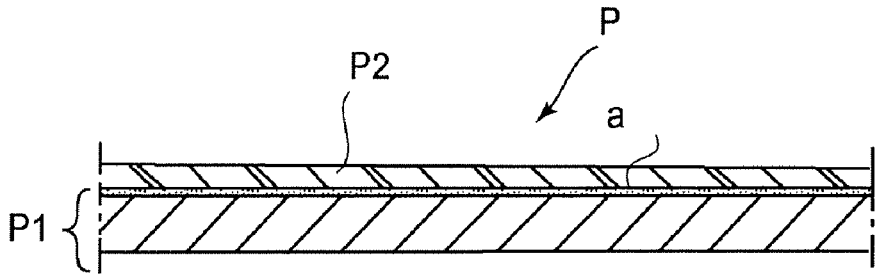
FIG. 6 is a schematic drawing showing the laminar structure of the resinous medium.

Next, an example of this type of recording medium (resinous medium) will be described. Referring to FIG. 6 which is a schematic drawing for showing the laminar structure of the resinous medium, a resinous medium is manufactured by placing a transparent resin layer P2 on the surface of a sheet of coated paper P1, as the substrate sheet (base sheet), that is, a sheet of paper having a coated pigment layer a, which is highly white flat, and smooth across its surface. That is, the resinous medium has the pigment layer under its resinous layer P2, having therefore a highly white, flat, and smooth surface, making it unnecessary to mix pigment into the material for the resinous layer P2 which is the outermost layer, in order to manufacture a highly white resinous medium. Thus, it is possible to design the resinous, thermoplastic, and transparent surface layer P2 while prioritizing the function of increasing a copy in glossiness and the function of embedding the toner image into the resinous medium. Further, the resinous medium in this embodiment has a merit in that it does not require the production of coated paper dedicated to the production of resinous medium.

As an example of the above described resinous medium, POD Super Gloss Coat Paper (product of Oji Paper Co., Ltd.), etc., are in the market.

Next, an example of the method for manufacturing the resinous medium used in this embodiment will be described. A sheet of ordinary paper, as a substrate, is coated with the abovementioned white pigment layer a, creating a coated paper P1 as the base paper. Then, one or both surfaces of the base paper are coated with thermoplastic resin with the use of a gravure coater to yield the desired recording medium (resinous medium).

As the resinous substance for forming the transparent resin layer P2, it is possible to use polyester resin, styrene-acrylic ester resin, styrene-methacrylic ester resin, etc.

However, it is preferable to use polyester resin. As the polyhydric alcoholic components and polyhydric carbonic components, there are the following substances:

1) polyatomic alcohol component:

Ethylene glycol, propylene glycol, 1,4-butane diol, 2,3-butane diol, diethylene glycol, triethyleneglycol, 1,5-pentane diol, 1,6-hexane diol, neopentyl glycol, 1,4-cyclohexanedimethanol, dipropyleneglycol, polyethylene glycol, polypropylene glycol, monomer of bisphenol A added with olefin oxide, or the like.

2) polyatomic carboxylic acid component:

Maleic acid, maleic anhydride, fumaric acid, phthalic acid, terephthalic acid, isophthalic acid, malonic acid, succinic acid, glutaric acid, dodecyl succinic acid, n-octyl succinic acid, n-dodecyl succinic acid, 1,2,4-benzenetri carboxylic acid, 1,2,4-cyclohexanetri carboxylic acid, 1,2,4-naphthalene tri carboxylic acid, 1,2,5-hexanetri carboxylic acid, 1,3-di carboxy-2 methyl-2-methylene carboxy propane, tetra(methylene carboxy) methane, 1,2,7,8-octane tetracarboxylic acid, trimellitic acid, pyromellitic acid, and low alkyl esters of these acids.

Polyester resin, as the material for the transparent resin layer P2, is synthesized through the polymerization of one or more among the abovementioned polyhydric alcoholic components, and one or more among the abovementioned polyhydric carbonic components.

As the material for the resinous component of color toner, polyester resin is used. As the material for the resinous component of black toner, styrene-acrylic resin is primarily used. Therefore, it is desired that a thermoplastic resin which is compatible with toner is chosen as the material for the transparent resin layer.

Therefore, one among the polyester resin, styrene-acrylic ester resin, styrene methacrylic ester resin, etc., or a mixture of two or more resins among them, is used as the material for the transparent resin layer.

Further, pigment, releasing agent, electrically conductional agent, etc., may be mixed into the material for the transparent resin layer P2 by an amount which is not large enough to affect the transparency of the transparent resin layer P2. If one or more among these ingredients are mixed, the amount of the primary component of the transparent resin layer P2 is desired to no less than 80% by weight. Further, the ratio among these components is desired to be adjusted so that the resultant transparent resin layer P2 is no less than $8.0\times 10^{8}\Omega$ in electrical resistance when the ambient temperature and relative humidity are 20 degrees and 85%, respectively.

Incidentally, the manufacturing method for the resinous medium does not need to be limited to the above described one. Further, as long as the resinous medium is provided with a thermoplastic layer, which softens at a temperature level close to the target temperature level of the belt-based fixing device F3, it does not need to be laminar. Moreover, additives such as pigment may be added to the material for the resinous medium, which is needless to say.

(6) Gloss Providing Mode

When the image forming apparatus is in the glossy copy outputting mode, that is, the mode for outputting a highly glossy full-color copy, a highly glossy monochromatic copy, or a highly glossy black-and-white copy, a resinous medium, that is, a recording medium which has a resinous layer as the image formation layer, is used as described above. The unfixed toner image or images are formed on the surface of the resinous layer.

In this embodiment, after the formation of the unfixed toner image(s) on the recording medium, the recording medium is introduced into the heat roller-based fixing device F1 in the apparatus main assembly 100, and the unfixed toner image(s) are preparatorily fixed to the recording medium in the heat roller-based fixing device F1. Then, the recording medium is introduced into the toner image pressing device F2 in the toner image pressing unit 300, and the pressure is applied to the preparatorily fixed copy, that is, the combination of the recording medium and the temporarily fixed toner image(s) on the recording medium. Lastly, the recording medium is guided into the belt-based fixing device F3 in the copy surface smoothing unit 400, in which the toner image(s) are embedded further into the resinous layer of the recording medium to yield a copy which is flat and smooth across the entire surface on the image bearing side. Thus, a desirable image, that is, a highly glossy image which is defect free, is outputted.

Incidentally, as described above, the amount of pressure applied by the belt-based fixing device F3 is set to be less than the amount of pressure applied by the fixing device F2, that is, the toner image pressing device. Thus, the problem that a toner image or toner images bleed when a preparatorily fixed copy, that is, a copy having a temporarily fixed toner image, is flattened and smoothed is prevented by making the role of embedding toner image(s) in the resinous medium to be borne primarily by the fixing device F2, that is, the toner image pressing device.

Further, the toner image pressing device F2 is not provided with a heater. Therefore, its temperature is lower than the target temperature of the belt-based fixing device F3 and the glass transition temperature of the toner. Thus, it does not occur that a toner image softens in the toner image pressing device F2. Therefore, it does not occur that toner offsets and/or a toner image bleeds.

Figure 10:
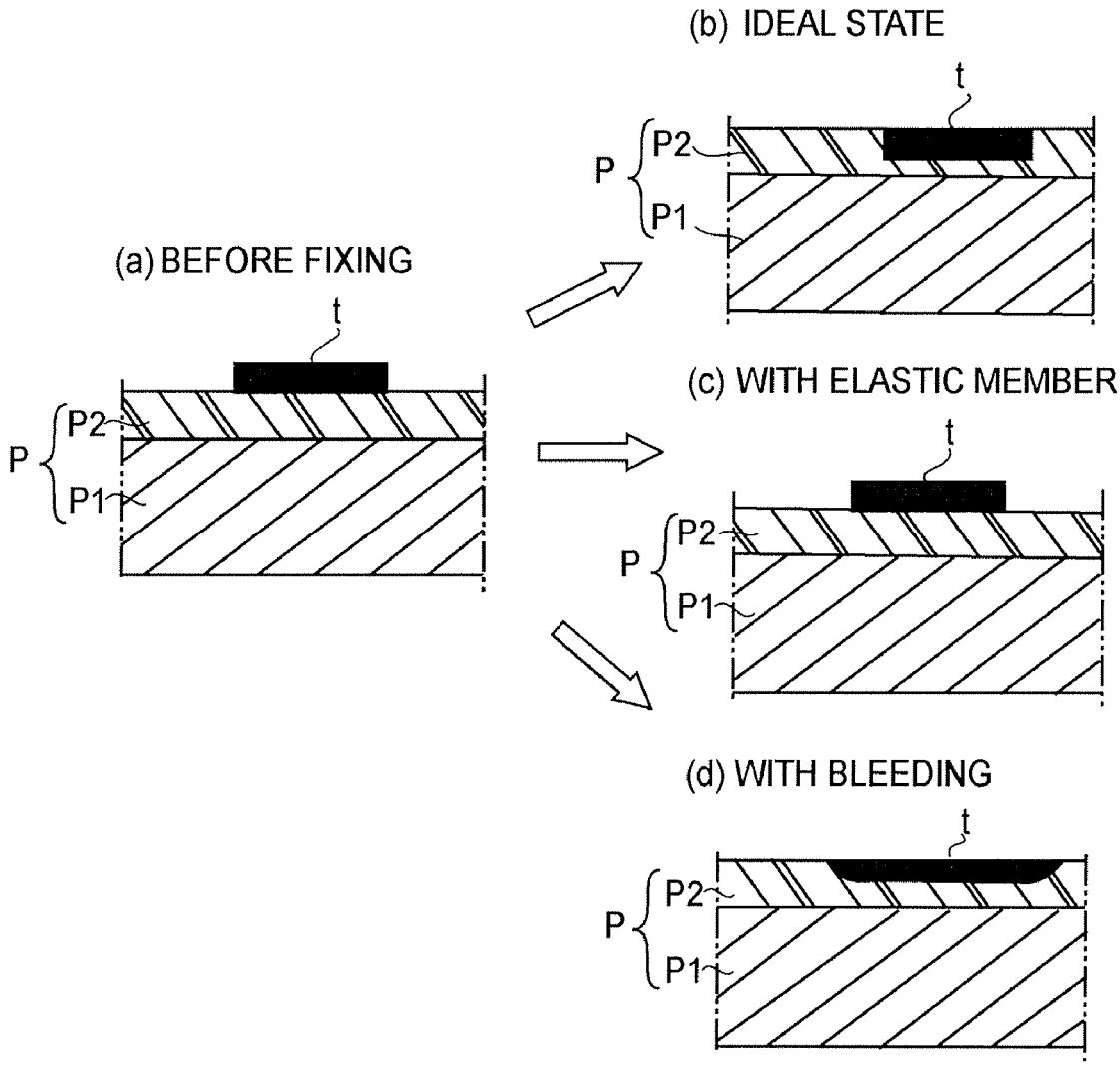
FIG. 10 is a schematic view of a fixed toner image.

As described above, in the case of the structural arrangement, in accordance with the prior art, for a glossy copy yielding image forming apparatus, if the amount of the toner in a toner image which had to be embedded in the resinous layer of a resinous medium is greater than a certain amount, it was difficult to embed the toner image into the resinous layer without squashing (spreading) the toner image (FIG. 10(*d*)). This embodiment solves this problem by keeping the temperature of the temporarily fixed tone image below the glass transition temperature Tg of the toner when applying pressure to the preparatorily fixed copy, that is, the combination of the recording medium and the temporarily fixed toner image thereon, by the belt-based fixing device F3 to embed the temporarily fixed toner image into the resinous layer of the resinous medium. That is, first, the temporarily fixed toner image is embedded into the resinous layer of the recording medium by applying pressure to the temporarily fixed toner with the use of the pair of pressure rollers, the temperature of which are kept below the glass transition temperature of the toner. Then, the recording medium is processed by the belt-based fixing device to reduce in height the toner image step. That is, the resinous layer of the recording medium, in which the toner image has been embedded, is subjected to the pressure applied by the belt-based fixing device to reduce in height the toner image step. During this process, the fixation temperature is low, and therefore, it does not occur that the toner image melts and bleeds. Therefore, it does not occur that a toner image fattens (spreads) by being squashed. Further, the height by which the toner image must be pressed down (embedded) into the resinous layer by the belt-based fixing device is substantially smaller. Thus, the structural arrangement of this glossy copy yielding image forming apparatus has a merit in that it is less taxing to the belt-based fixing device.

As described above, the glossy copy yielding image forming apparatus is structured so that the flattening-and-smoothing process is carried out by the belt-based fixing device after the pressing process (embedding process) is carried out by the toner image pressing device. Therefore, it can yield a highly glossy copy of high quality, more specifically, a highly glossy copy which is free of bleeding.

In this embodiment, when the image forming apparatus is in the glossy copy outputting mode, resinous medium is guided into the heat roller-based fixing device F1 to preparatorily fix the toner image before the resinous medium is guided into the toner image pressing device F2. Therefore, the amount by which toner is offset by the toner image pressing device F2 is minimized.

As described above, in this embodiment, the heat roller-based fixing device F1 plays the role of preventing toner from being made to offset by the toner image pressing device F2.

Incidentally, the role which the heat roller-based fixing device F1 is to play when the image forming apparatus in the glossy copy outputting mode is to prevent toner from being made to offset by the toner image pressing device F2. Therefore, the temperature of the heat roller-based fixing device F1 can be controlled by switching the operational mode to the preliminary fixation mode.

Also in this embodiment, the recording medium used when the image forming apparatus in the glossy copy outputting mode is the recording medium made up of the coated paper P1, as the substrate, which is 170 g/m$^2$ in basis weight, and the 15 μm thick transparent resin layer P2 which is coated on the substrate, and the primary component of which is polyester.

When the height of the full-color toner image relative to the area of the surface of the recording medium, which is free of toner, was measured after the fixing process is carried out by the heat roller-based fixing device F1, the height of the highest point of the toner image was 12 μm.

As an unfixed toner image is preparatorily fixed by the heat roller-based fixing device F1 when the image forming apparatus is in the glossy copy outputting mode, the height of the toner image reduces by roughly 50% as it does when the image forming apparatus is in the normal image forming mode. In terms of the direction parallel to the surface of the recording medium, however, virtually no change occurs to the dimension of the toner image. Therefore, it is reasonable to think that the change in the height of the toner image is a volumetric change, that is, the toner image is reduced in volume by the amount equal to the amount of the air which is forced out of the toner image by the pressure application by the heat roller-based fixing device F1. That is, the height of the toner image, which is roughly 20-30 μm before the fixation, is changed to 10-15 μm by the fixing process carried out by the heat roller-based fixing device F1.

In this embodiment, in the highly glossy copy outputting mode, the heat roller-based fixing device F1 is used in the preparatory fixation mode. Therefore, all the air in the toner image is not forced out. Therefore, even after the completion of the fixing process by the heat roller-based fixing device F1, the surface of the toner image still remains more or less uneven. In this embodiment, the height of the toner image after the fixation by the heat roller-based fixing device F1 was roughly 15-20 μm.

The fixation temperature of the heat roller-based fixing device F1 was set to 170 degrees, and the process speed of the heat roller-based fixing device F1 was set to 200 mm/sec.

Figure 7:
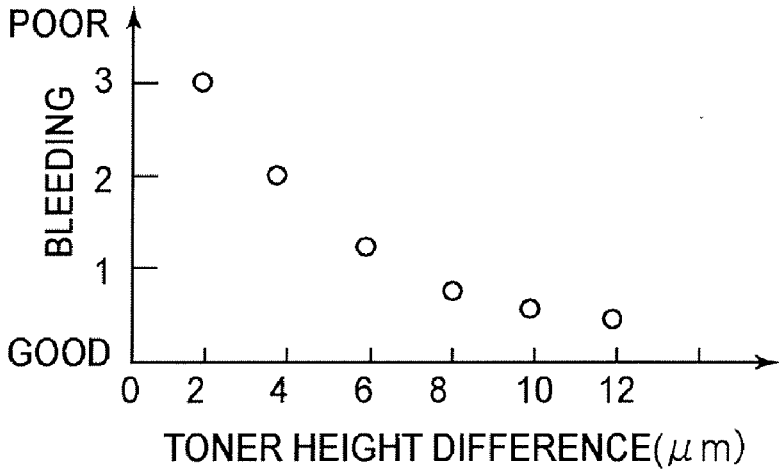
FIG. 7 is a graph showing the relationship between the height of the toner image step immediately after the belt-based smoothing (fixation) and the level of toner image bleeding.

Next, the relationship between the toner image height and the extent of toner image bleeding will be described. FIG. 7 shows the relationship between the height (μm) of the toner image step after the belt-based fixing device F3 was used without using the toner image pressing device F2, and the toner image bleeding. The height of toner image step, which is represented by the horizontal axis of the graph in FIG. 7, is the height of toner image step after the toner image was fixed by the heat roller-based fixing device F1. The relationship is such that the lower the toner image step, the worse the bleeding. However, when the amount by which the toner image step was reduced was 6 μm, the amount by which the bleeding worsened was slight. Thus, it became evident that as long as the toner image step can be reduced to a value no greater than 6 μm before the recording medium is guided into the belt-based fixing device F3, the amount of toner image bleeding can be kept negligibly small.

Thus, it was studied how to reduce the toner image step by the fixing device F2, that is, the toner image pressing device before guiding the recording medium into the belt-based fixing device F3. As the recording medium is conveyed through the toner image pressing device F2, the temperature of the toner image pressing device F2 slightly increased above the room temperature, because of the heat given by the recording medium because the recording medium has just been conveyed through the heat roller-based fixing device F1. However, it never increased above the glass transition temperature Tg of the toner. The glass transition temperature Tg of the toner used in this embodiment was 60 degrees, and the temperature of the pressure roller 61 (fixation roller) was 42 degrees.

Figure 8:
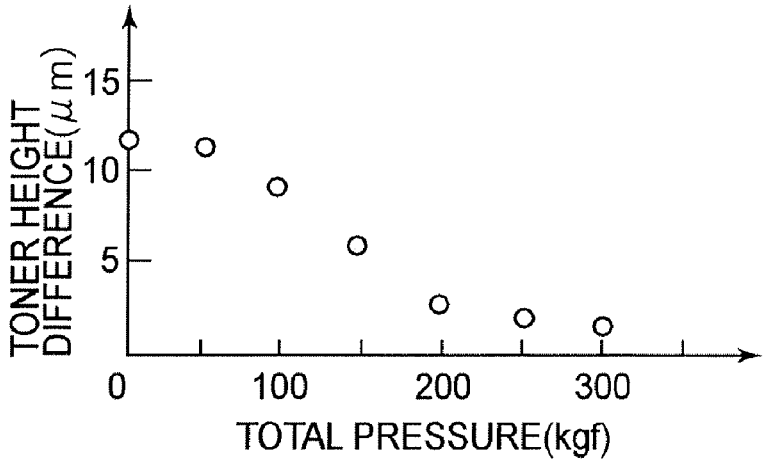
FIG. 8 is a graph showing the relationship between the amount of fixation pressure applied by the belt-based smoothing (fixing) device, and the height of the toner image step.

Shown in FIG. 8 is the relationship between the amount of the pressure applied by the fixing device F2, that is, the toner image pressing device, and the height of the toner image step. It is evident from FIG. 8 that the higher the pressure, the lower the toner image step, and that the application of a total amount of pressure of 1470 N (150 kgf) reduces the height of the toner image step to 6 μm. The height of the toner image step before the pressure application by the toner image pressing device F2 is the same as the height of the toner image step after the pressure application by the heat roller-based fixing device F1. The higher the pressure, the lower the toner image step. However, the higher the pressure, the more likely it is for an additional problem to occur, that is, for the entirety of the resinous medium itself to be squashed and spread, and/or made wavy.

The visual studies of the cross section of the resinous medium revealed the reason why the height of the toner image step reduce without bleeding. That is, the reduction in the height of the toner image step occurred because the substrate (actual paper) portion of the resinous medium was squashed, being thereby reduced in thickness, whereas there was virtually no change in the height of the toner image itself and the thicknesses of the resinous surface layer.

As described above, the toner image was fixed by the heat roller-based fixing device F1, and the height of the toner image step was reduced by the toner image pressing device F2. Then, the combination of the resinous medium and the toner image thereon was made flatter and smoother, across the tone image side, by the belt-based fixing device F3, in order to make the toner image bearing side of the combination not only highly glossy, but also, uniform in gloss.

Therefore, it was possible to output a satisfactory high gloss copy, that is, a highly glossy copy with no defect.

The glossiness increasing unit may be structured so that in the case that the toner offset attributable to the toner image pressing device F2 is negligible, the heat roller-based fixing device F1 can be skipped, that is, the recording medium (which is bearing the unfixed toner image) is guided into the toner image pressing device F2, without being introduced into the heat roller-based fixing device F1, and then, is guided into the belt-based fixing device F3.

Embodiment 2

Figure 9:
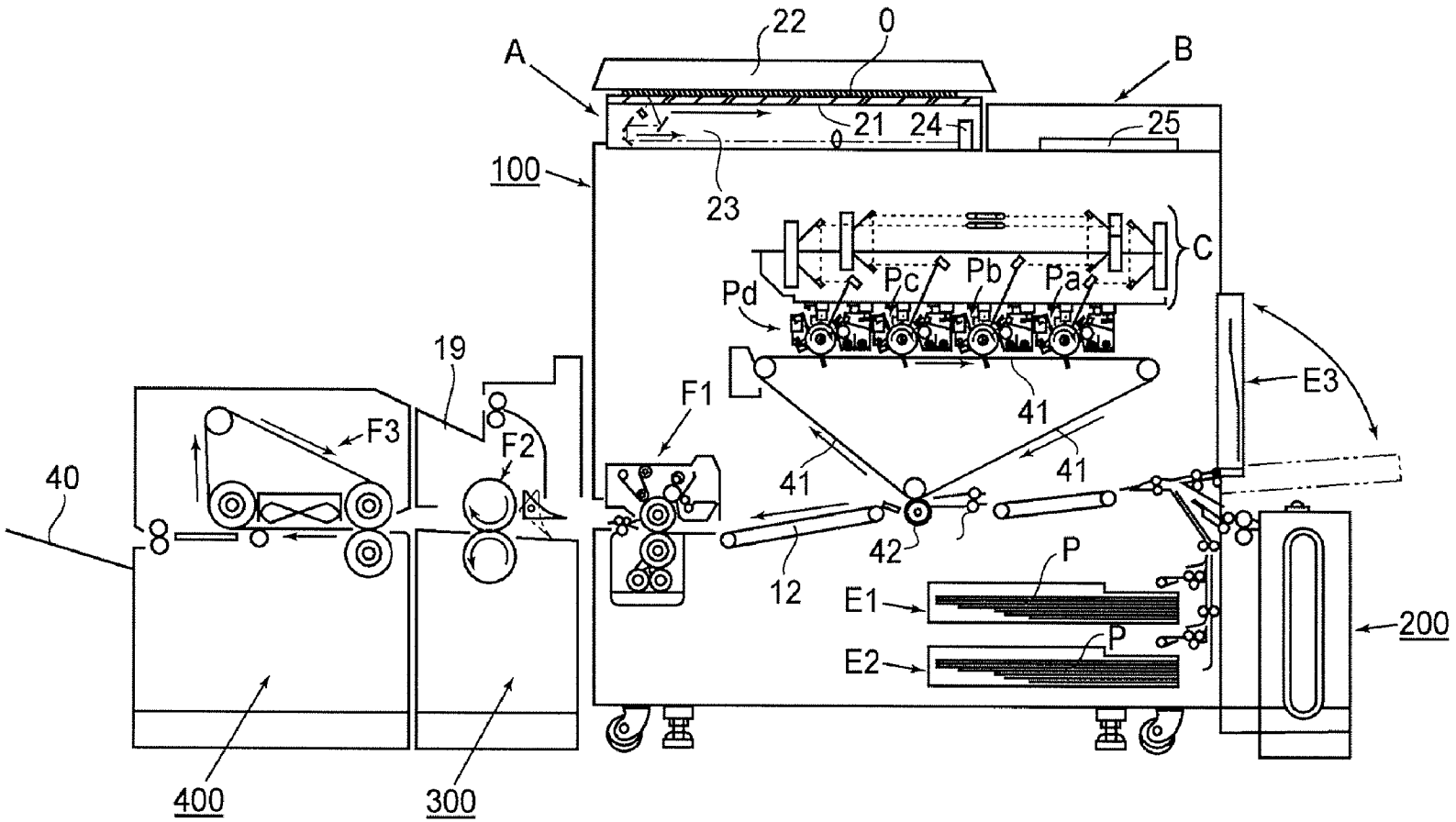
FIG. 9 is a schematic drawing of the glossy copy outputting image forming apparatus in the second embodiment of the present invention, showing the structure of the apparatus.

FIG. 9 is a schematic drawing of the glossy copy outputting image forming apparatus in this embodiment, and shows the general structure of the apparatus. This image forming apparatus is also an electrophotographic full-color recording apparatus having four drums juxtaposed in parallel, like the recording apparatus in the first embodiment, except that the recording apparatus in this embodiment employs an intermediary image transfer system (intermediary transfer belt 41). Thus, while the intermediary transfer belt 41 is circularly driven in the clockwise direction, that is, the direction indicated by an arrow mark, unfixed toner images are sequentially placed in layers on an intermediary transfer belt 41 by the first to fourth image forming portions Pa, Pb, Pc, and Pd. Then, the unfixed toner images on the intermediary transfer belt 41 are transferred (secondary transfer) together by a secondary transfer roller 42 onto the recording medium P. Except for the provision of the intermediary transfer system, the recording apparatus in this embodiment is roughly the same, in structure, image formation process, control sequence, etc., as the recording apparatus in the first embodiment.

In the case of the recording apparatus in this embodiment, the height of the toner image step after the fixation by the heat roller-based fixing device F1, that is, the fixing apparatus of the apparatus main assembly, was 10 μm.

One of the differences between this embodiment and first embodiment is that the toner used in the first embodiment was toner made by pulverization, whereas the toner used in this embodiment was polymer toner, which is smaller in toner particle diameter.

Another difference was structural; the surface layer of the fixation roller in this embodiment was harder. Since the height of the toner image step after the fixation by the heat roller-based fixing device F1 was 10 μm, the amount of pressure to be applied by the toner image pressing device F2 was set to 1176 N (120 kgf). Reduction in the amount of the pressure applied by the toner image pressing device F2 allows an apparatus designer to reduce the apparatus in rigidity, being therefore advantageous from the standpoint of cost, and also, can extend the lives of the pair of pressure rollers 61 and 62.

Also in this embodiment, the toner image was fixed by the heat roller-based fixing device F1, and the height of the toner image step was reduced by the toner image pressing device F2. Then, the combination of the resinous medium and the toner image thereon was made flatter and smoother, across the tone image side, by the belt-based fixing device F3, in order to make the toner image bearing side of the combination not only highly glossy, but also, uniform in gloss.

Therefore, it was possible to output a satisfactory high gloss copy, that is, a highly glossy copy with no defect.

Also in the case of this embodiment, the glossiness increasing system may be structured so that in the case that the toner offset attributable to the toner image pressing device F2 is negligible, the heat roller-based fixing device F1 can be skipped, that is, the recording medium (which is bearing the unfixed toner image) can be guided into the toner image pressing device F2, without being introduced into the heat roller-based fixing device F1, and then, is guided into the belt-based fixing device F3.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 171551/2006 filed Jun. 21, 2006 which is hereby incorporated by reference.

What is claimed is:

1. A glossy image forming system for forming a glossy image on a recording material having a surface resin material layer, said glossy image forming system comprising:

a fixing device for fixing an unfixed toner image formed on a surface of the recording material;

a heaterless pressing device for pressing the recording material having the toner image fixed by said fixing device; and a smoothing device for smoothing the surface of the recording material pressed by said heaterless pressing device with a pressure smaller than a pressure applied by said heaterless pressing device.

2. A system according to claim 1, wherein said heaterless pressing device includes a pair of rotating members for nipping and feeding the recording material, and a temperature of said rotating members are maintained at a level lower than a glass transition point temperature of toner of the toner image.

3. A system according to claim 1, wherein said smoothing device provides a glossiness (60°) of not less than 80 and not more than 110 with the surface of the recording material.

4. A system according to claim 1, wherein said smoothing device includes a belt contactable to the surface of the recording material and having a glossiness (60°) of not less than 80 and not more than 110, a rotatable member for close-contacting the recording material to said belt and for nipping and feeding the recording material between said belt and said rotatable member, a cooling device for cooling the recording material moving in contact to said belt prior to separation from said belt.

5. A system according to claim 4, wherein said cooling device cools the recording material to a temperature lower than the glass transition point temperature of the toner.

6. A glossy image forming system for forming a glossy image on a recording material having a surface resin material layer, said glossy image forming system comprising:

a fixing device for fixing an unfixed toner image formed on a surface of the recording material;

a heaterless pressing device for pressing the recording material having the toner image fixed by said fixing device;

a belt having a glossiness (60°) of not less than 80 and not more than 110 and movable while being in contact to the surface of the recording material;

a rotatable member cooperable with said belt to feed the recording material while being in contact to said belt by nipping the recording material therebetween with a pressure smaller than a pressure applied by said heaterless pressing device; and a cooling device for cooling the recording material moving in contact to said belt prior to separation of the recording material from said belt.

7. A system according to claim 6, wherein said pressing device includes a pair of rotating members for nipping and feeding the recording material, and a temperature of said rotating members are maintained at a level lower than a glass transition point temperature of toner of the toner image.

8. An apparatus according to claim 6, wherein said cooling device cools the recording material to a temperature lower than the glass transition point temperature of the toner.

9. A smoothing apparatus for smoothing a surface of the recording material to provide a glossy image with a surface of the recording material having a surface resin material layer, comprising:

a heaterless pressing device for pressing the recording material having a toner image fixed on the surface of the recording material;

a belt having a glossiness (60°) of not less than 80 and not more than 110 and movable while being in contact to the surface of the recording material;

a rotatable member cooperable with said belt to feed the recording material while being in contact to said belt by nipping the recording material therebetween with a pressure smaller than a pressure applied by said heaterless pressing device; and a cooling device for cooling the recording material moving in contact to said belt prior to separation of the recording material from said belt.

10. An apparatus according to claim 9, wherein said heaterless pressing device includes a pair of rotating members for nipping and feeding the recording material, and a temperature of said rotating members are maintained at a level lower than a glass transition point temperature of toner of the toner image.

11. An apparatus according to claim 9, wherein said cooling device cools the recording material to a temperature lower than the glass transition point temperature of the toner.

* * * * *